US006518552B2

(12) United States Patent
Takagi et al.

(10) Patent No.: US 6,518,552 B2
(45) Date of Patent: Feb. 11, 2003

(54) FIXING DEVICE USING INDUCTION HEATING IN IMAGE FORMING SYSTEM

(75) Inventors: Osamu Takagi; Satoshi Kinouchi, both of Tokyo-To (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/852,770

(22) Filed: May 11, 2001

(65) Prior Publication Data

US 2002/0017519 A1 Feb. 14, 2002

Related U.S. Application Data

(62) Division of application No. 09/473,058, filed on Dec. 28, 1999, now Pat. No. 6,252,212.

(51) Int. Cl.[7] ..... H05B 6/14; G03G 15/20

(52) U.S. Cl. ..... 219/619; 219/670; 219/672; 399/330

(58) Field of Search ..... 219/619, 672, 219/674, 676, 670; 399/330, 328, 334, 335, 336

(56) References Cited

U.S. PATENT DOCUMENTS

| | | | | |
|---|---|---|---|---|
| 5,552,582 A | * | 9/1996 | Abe et al. | 219/619 |
| 5,568,240 A | * | 10/1996 | Ohtsuka | 219/619 |
| 5,713,069 A | | 1/1998 | Kato | 399/330 |
| 5,752,150 A | | 5/1998 | Kato et al. | 399/330 |
| 6,026,273 A | | 2/2000 | Kinouchi et al. | 399/328 |
| 6,049,691 A | | 4/2000 | Abe et al. | 219/619 |
| 6,078,781 A | | 6/2000 | Takagi et al. | 399/330 |
| 6,087,641 A | | 7/2000 | Kinouchi et al. | 219/619 |
| 6,255,633 B1 | | 7/2001 | Takagi et al. | 219/619 |

* cited by examiner

*Primary Examiner*—Philip H. Leung
(74) *Attorney, Agent, or Firm*—Foley & Lardner

(57) ABSTRACT

A fixing device using induction heating includes an endless member having a metal layer of a conductive material; and an electromagnetic induction coil arranged close to said endless member, alternating current being supplied to said coil, thereby generating heat to heat up said endless member, said coil being wound onto a core member arranged in a width direction of said endless member, and an expansion of a folded portion of said coil being absorbed by a narrower portion of said core member, thereby maintaining to be constant the width of a gap between said coil and said endless member.

6 Claims, 13 Drawing Sheets

FIXING DEVICE USING INDUCTION HEATING IN IMAGE FORMING SYSTEM

This application is a divisional of Ser. No. 09/473,058 filed Dec. 28, 1999 U.S. Pat. No. 6,252,212.

BACKGROUND OF THE INVENTION

1. Field of the Invention

The present invention relates generally to a fixing device using the induction heating, which is used for fixing an image, such as a toner image, on a fixed material, such as a paper, in an image forming system, such as an electrophotography system, an electrostatic process copying machine or a laser printer, and a method for producing the same.

2. Related Background Art

Conventionally, there is known the following fixing device for an electrophotography system. That is, a halogen lamp or the like is used as a heat source. This is provided inside of a heating roller of a metal to heat the heating roller. A pressure roller having an elastic material at least on the surface thereof is provided so as to face the heating roller while pressingly contacting the heating roller. A paper serving as a fixed material is caused to pass through a nip portion formed between the two rollers contacting each other. During the passing, a toner image on the paper is melted and fixed. There is also known a fixing device wherein a flash lamp is used for heating a paper without contacting the paper to fix a toner image. Moreover, as fixing devices having improved efficiency, there are known a fixing device having magnetic field producing means combined with a belt as shown in Japanese Patent Laid-Open No. 8-76620, and a fixing device using a heating member of a ceramics as shown in Japanese Patent Laid-Open No. 59-33476.

However, there are various problems in the above described conventional fixing devices. That is, in the fixing device utilizing the induction heating based on an induction coil, it is actually very difficult to uniformly heat the heating roller. In order to optimize the heating efficiency to realize the uniform heating, it is required to optimize the construction of the induction coil itself, but this is actually remarkably difficult.

With respect to the uniform heating of the heating roller, it is also required to prevent the non-uniformity of temperature of the heating roller in axial directions (cross directions) thereof. The conventional device using the halogen lamp heater is designed to cope with it by changing the light distribution characteristics. Also in the induction heating fixing devices, it is required to take measures to obtain the same effects. That is, it is required to take measures to cause heating distribution to be uniform.

SUMMARY OF THE INVENTION

It is therefore an object of the present invention to eliminate the aforementioned problems and to provide a fixing device using induction heating capable of efficiently and uniformly heating a heating roller, easily winding coils onto a core, appropriately fixing on a paper without being affected by the turning ON/OFF of a power supply, and inhibiting the generation of noises, and a method for producing the same.

In order to accomplish the aforementioned and other objects, according to one aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein going and returning portions of one turn of the coil are spaced from each other by a predetermined distance or more so as to inhibit electromagnetic fields formed by the going and returning portions from being canceled out.

According to another aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein the coil is wound so as to extend in axial directions of the endless member, and a gap between the coil and an object induction-heated by the coil is set so as not to be less than in end portions of the coil.

According to another aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein the coil is wound as a multiplex winding so as to extend in axial directions of the endless member, and a gap between an inside turn of the coil and an object induction-heated by the inside turn of the coil is set to be substantially uniform even in both a central portion and an end portion of the coil.

According to another aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein the coil is wound as a multiplex winding so as to extend in axial directions of the endless member, and a heat generation distribution of an object to be heated is optimized by changing distances between the outermost turn of the coil and other turns thereof inward of a core.

According to another aspect of the present invention, there is provided a fixing device using induction heating for causing alternating current to pass through electromagnetic induction coils, which are arranged so as to be close to an endless member having a metal layer of a conductive material, to cause the endless member to generate heat to heat a member to be fixed, wherein the coil is wound so as to extend in axial direction of the endless member, and a turn of the coil next to a certain turn thereof is sequentially wound onto the outside of the certain turn, the certain turn having a U-turn portion, at least a part of which is bent so as to have a radius R of curvature, and wherein a relationship between the radius R and a distance D between going and returning portions of the certain turn is set to be a predetermined relationship.

According to another aspect of the present invention, there is provided a method for producing a fixing device using induction heating for causing alternating current to pass through an electromagnetic induction coil, which is arranged so as to be close to an endless member having a metal layer of a conductive material, to cause the endless member to generate heat to heat a member to be fixed, wherein the coil is wound onto an outside peripheral surface of a substantially cylindrical core so as to extend in axial directions thereof, the core having core bodies, onto which a first turn of the coil is wound to be supported, on the outside peripheral surface at two places facing each other in radial directions, each the core body extending in the axial directions, and wherein the first turn of the coil is wound onto each of the core body, and then, the next turn of the coil is wound next to the first turn to sequentially carry out this procedure so that substantially half of the coil is wound onto the outside peripheral surface of the core, and wherein after the coil is wound by the procedure to cover substantially half of the outside peripheral surface of the core with respect to at least one of the two core bodies, the coil is wound by the procedure with respect to the other core body to cover the remaining half of the outside peripheral surface of the core, so that the coil substantially covers the whole surface of the outside peripheral surface of the core.

According to a further aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein the coil has non-central portions of non-dense coil portions on both ends of the. coil in axial directions, and the vicinity of the non-central portions are provided so as to face a fixed portion of the member to be fixed.

According to a still further aspect of the present invention, there is provided a fixing device using induction heating for causing alternating current to pass through an electromagnetic induction coil, which is arranged so as to be close to an endless member having a metal layer of a conductive material, to cause the endless member to generate heat to heat a member to be fixed, wherein two outgoing lines of going and returning portion of the coil are attached to each other.

BRIEF DESCRIPTION OF THE DRAWINGS

The present invention will be understood more fully from the detailed description given herebelow and from the accompanying drawings of the preferred embodiments of the invention. However, the drawings are not intended to imply limitation of the invention to a specific embodiment, but are for explanation and understanding only.

In the drawings.

DESCRIPTION OF THE PREFERRED EMBODIMENTS

Referring now to the accompanying drawings, the preferred embodiments of the present invention will be described below.

Figure 1:
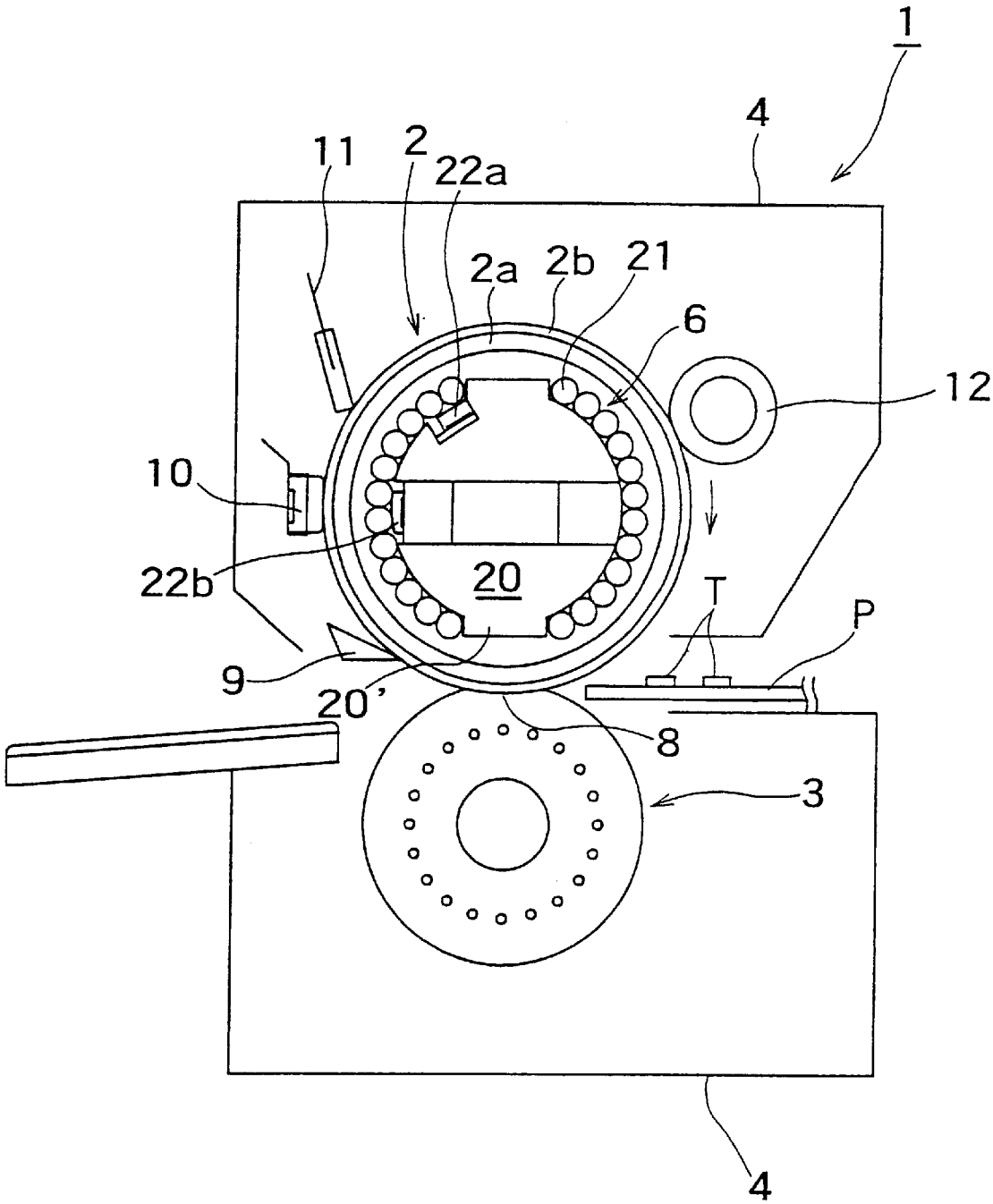
FIG. 1 is a schematic side view showing the whole construction of a preferred embodiment of a fixing device according to the present invention.
Figure 2:
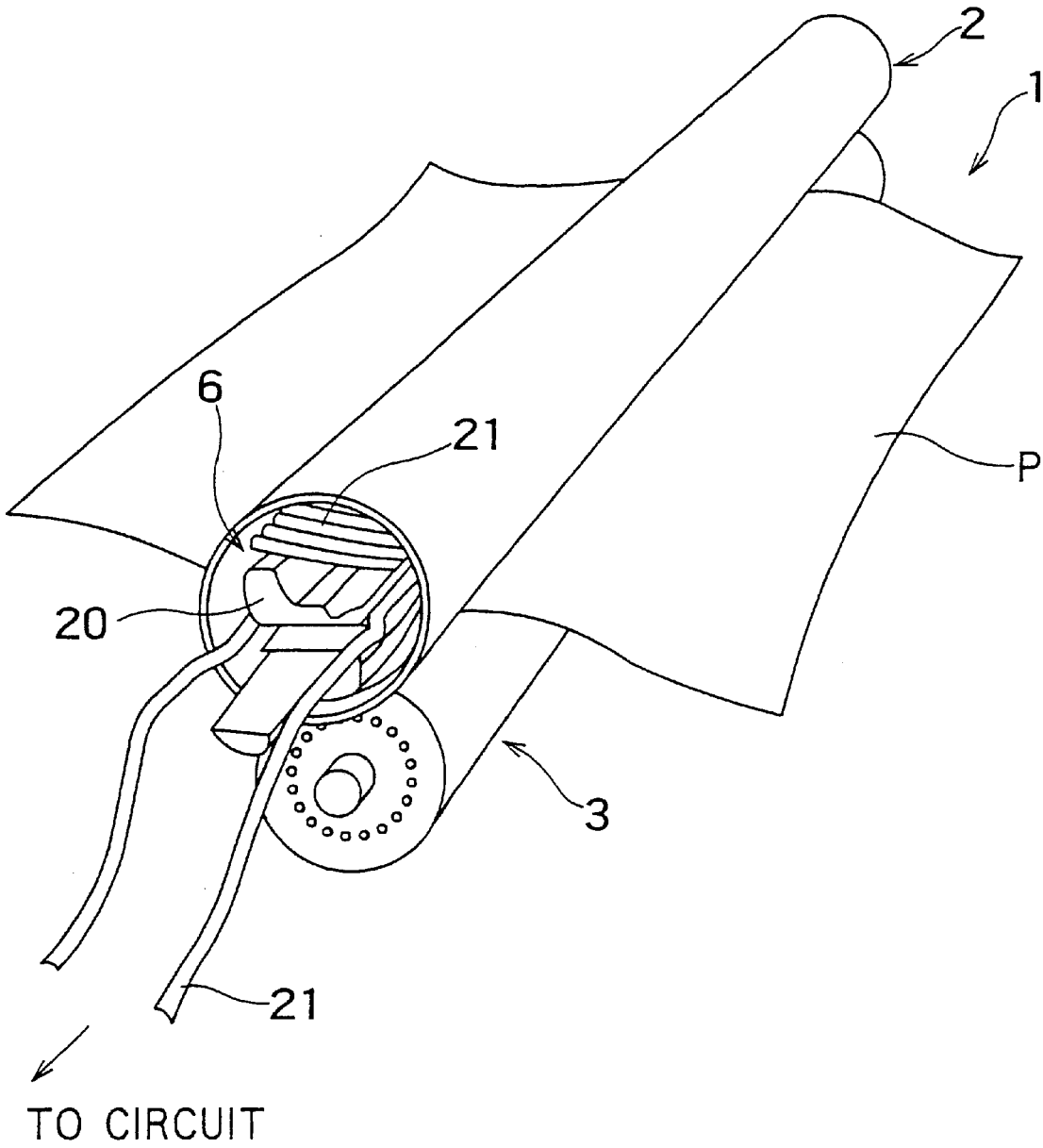
FIG. 2 is a schematic perspective view showing a heating roller, an induction heating device and a pressure roller of the fixing device shown in FIG. 1.
Figure 15:
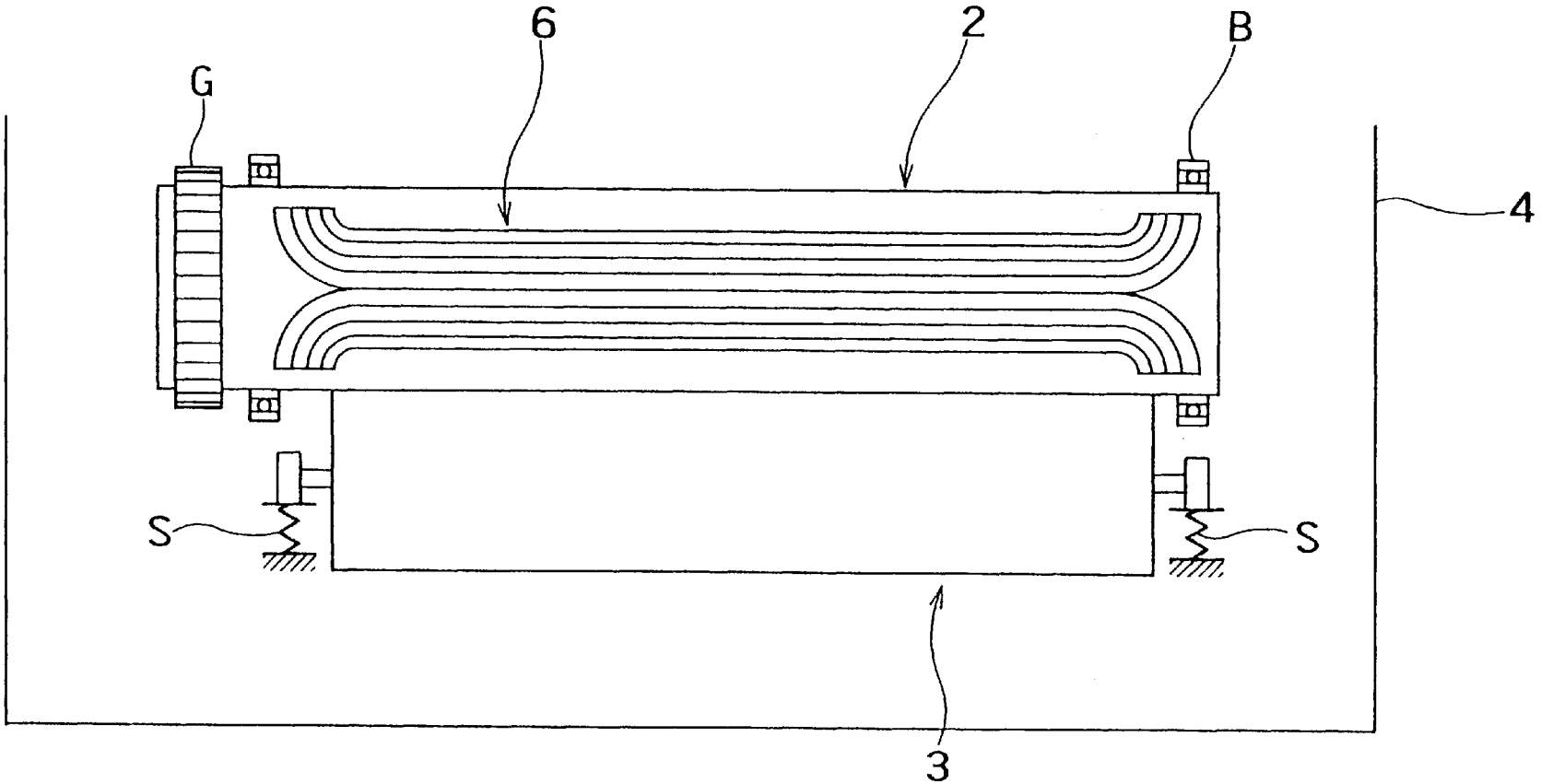
FIG. 15 is an illustration showing a heating roller and pressure roller which are supported on a body.

FIG. 1 is a schematic sectional view of the whole construction of a fixing device 1 for fixing a toner image serving as an image on a fixed material (a paper) in an electrostatic process copying machine or the like. FIG. 2 is a perspective view of a principal part (a heating roller 2 and a pressure roller 3) of the fixing device 1 with a paper P. FIG. 15 shows the relationship between the positions of the two rollers.

The fixing device 1 is designed to melt and fix a toner on the paper P serving as a fixed material by causing the paper P, which is arranged on the right side in FIG. 1, to pass through a portion (nip portion) between the upper high-temperature heating roller (fixing roller) 2 and the lower pressure roller (press roller) 3, which pressingly contact each other, from the right to the left.

Specifically, the heating roller 2 is supported on a bearing B (FIG. 15) rotatably with respect to a body (chassis) 4, and rotated clockwise by a driving motor (not shown). The heating roller 2 is formed of an endless member, e.g., a cylindrical member of $\phi$40 mm. For example, the heating roller 2 may be formed by winding a heat resistant belt between two pulleys to house therein an induction heating device 6, which will be described later, as long as it is formed of an endless member. The pressure roller 3 is rotatably mounted on the body 4 so as to pressingly contact the heating roller 2. For example, as can be seen from FIG. 15, the rotatably supported pressure roller 3 may be biased by springs S against the heating roller 2 so as to pressingly contact the heating roller 2. That is, the pressure roller 3 pressingly contacts the heating roller 2 to be held so as to form a nip portion 8 having a predetermined width. The pressure roller 3 itself has no driving mechanism, and is driven counterclockwise by the heating roller 2.

Moreover, the heating roller 2 has a double structure, the inside structure of which comprises a body 2*a* of iron having a thickness of, e.g., 1 mm. In place of iron, stainless, aluminum, a composite material of stainless and aluminum, or the like may be used. The outside surface of the body 2*a* is coated with a mold releasing layer 2*b* of teflon or the like. In addition, the pressure roller 3 pressingly contacting the heating roller 2 has a double structure comprising a core 3*a* and an outside coating layer 3*b* of an elastic material, such as silicon rubber or fluoro rubber, for coating the core 3*a*.

In the internal cavity of the heating roller 2, the induction heating device (magnetic field generating means) 6 is provided so as to be fixed to the body 4. By the induction heating device 6, the iron body 2*a* of the heating roller 2 is heated. By the heating roller 2 thus heated, the developer (toner) on the paper P is melted and fixed.

Around the heating roller 2, various devices are provided. That is, slightly downstream of the contact position (nip portion) 8 between the heating roller 2 and the pressure roller 3 in rotation directions, a peeling claw 5 for peeling the paper P from the heating roller 2 is provided. Downstream of the peeling claw 5 in rotational directions, a thermistor 10 for detecting the temperature of the heating roller 2 is provided. Downstream of the thermistor 10, a cleaning member 11 for removing refuse, such as offset toner and waste papers, is provided. Downstream of the cleaning member 11, i.e., upstream of the nip portion 8, at which fixing is carried out, a mold releasing agent applying device 12 for applying a mold releasing agent for preventing the offset of the toner is provided.

Then, the induction heating device 6 will be described in detail. The device 6 comprises a core (coil supporting member) 20 of a heat resistant resin, such as a high heat resistant industrial plastic, and an exciting coil 21 wound onto the core 20. The exciting coil 21 allows alternating current to effectively pass through a litz wire. For example, the coil 21 is formed of a bundle of 19 unit wires, each of which is coated with a heat resistant polyamideimide and each of which has a diameter of 0.5 mm. As described above, the coil 21 is magnetically a so-called air-core coil which does not have a magnetic core, such as a ferrite or iron core, since the coil 21 is supported on the non-magnetic core 20. Thus, since it is not required to use any iron cores having a complicated shape, it is possible to reduce the costs, so that it is possible to provide an inexpensive magnetic circuit. Furthermore, in the figure, reference numbers 22*a* and 22*b* denote coil temperature sensors.

A high-frequency current is supplied from an exciting circuit (not shown), such as an inverter circuit, to the exciting coil 21 to generate an eddy current in the heating roller 2 in accordance with the variation in magnetic field. By this eddy current, the heating roller 2 produces Joule heat by its electrical resistance to be heated. For example, it is possible to cause a high-frequency current having a frequency of 25 kHz and 900 W to pass through the exciting coil 21.

The induction heating device 6 in the heating roller 2 will be described in detail below. The induction heating device 6 can be embodied in various ways, and each of examples thereof will be described below.

The relationship between the core 20 and the coils 21 wound onto the core 20 in the above described induction heating device 6 will be described below.

Figure 3:
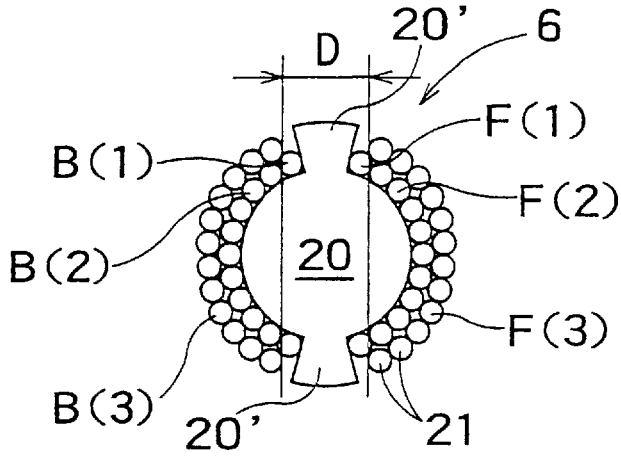
FIGS. 3(*a*) through 3(*c*) are cross-sectional views of coils wounded onto a core.
Figure 3:
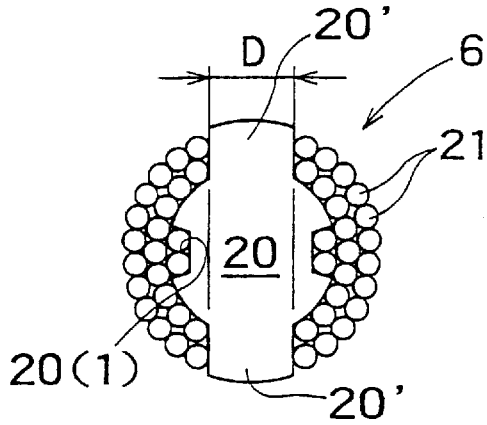
Figure 3:
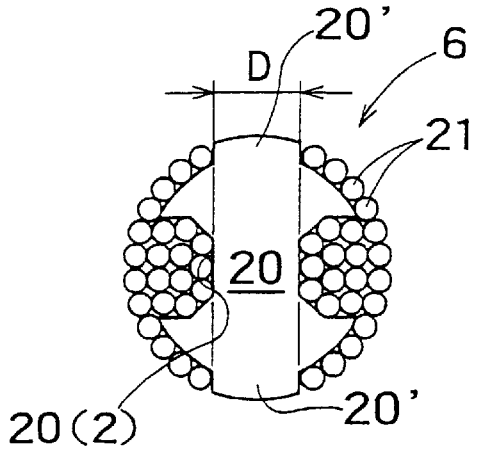

FIGS. 3(*a*) through 3(*c*) show cross sections of different examples. In these figures, a distance D denotes a required clearance serving as a minimum distance, by which going coils 21(F1), 21(F2), . . . and returning coils 21(B1), (B2), (B3), . . . which are associated with the going coils to form one turn, can approach to each other. That is, if the going coils are too close to the returning coils, the magnetic fields formed by the respective coils are canceled out. Therefore, in order to avoid this, the going coils and returning coils of one turn must be spaced from each other by a predetermined distance. This predetermined distance is expressed by D in the figure. Therefore, FIGS. 3(*a*) through 3(*c*) show examples of duplex, triplex, quadruplex windings of coils 21. In either example, the distances between the going coils and returning coils of one turn are greater than the distance D. Specifically, in FIG. 3(*a*), in each one turn, the going coil (F1) and returning coil (B1), the going coil (F2) and returning coil (B2), and the going coil (F3) and returning coil (B3) are spaced from each other by a greater distance than the distance D. In FIGS. 3(*b*) and 3(*c*) showing the triplex and quadruplex windings, the first layer and second and third layers are embedded in grooves 20(1) and 20(2) formed in the core 20, respectively, so that the outer diameter of the coil 21 of the finally wound outermost layer is constant. In these figures, when the coils 21 are wound as a multiplex winding, there is adopted a so-called straw bag stacking wherein the upper layer coil is offset from the lower layer coils so that the upper layer coil 21 is received by a groove formed by adjacent two of the lower layer coils. Thus, when the outside coil is wound by a greater tension than that of the inside coil, the upper and lower layer coils are closely stacked up, the shape of the outermost periphery approaches an appropriate circle, so that the gap between the outside surfaces of the coils and the inside surface of the heating roller 2 (the metal body 2*a*) covering the coils is more uniform. Thus, the temperature for heating the heating roller 2 is uniform and appropriate. Furthermore, in the cores in FIGS. 3(*a*) through 3(*c*), reference number 20' denotes a core body, onto which the coil 21 is first wound.

Figure 4:
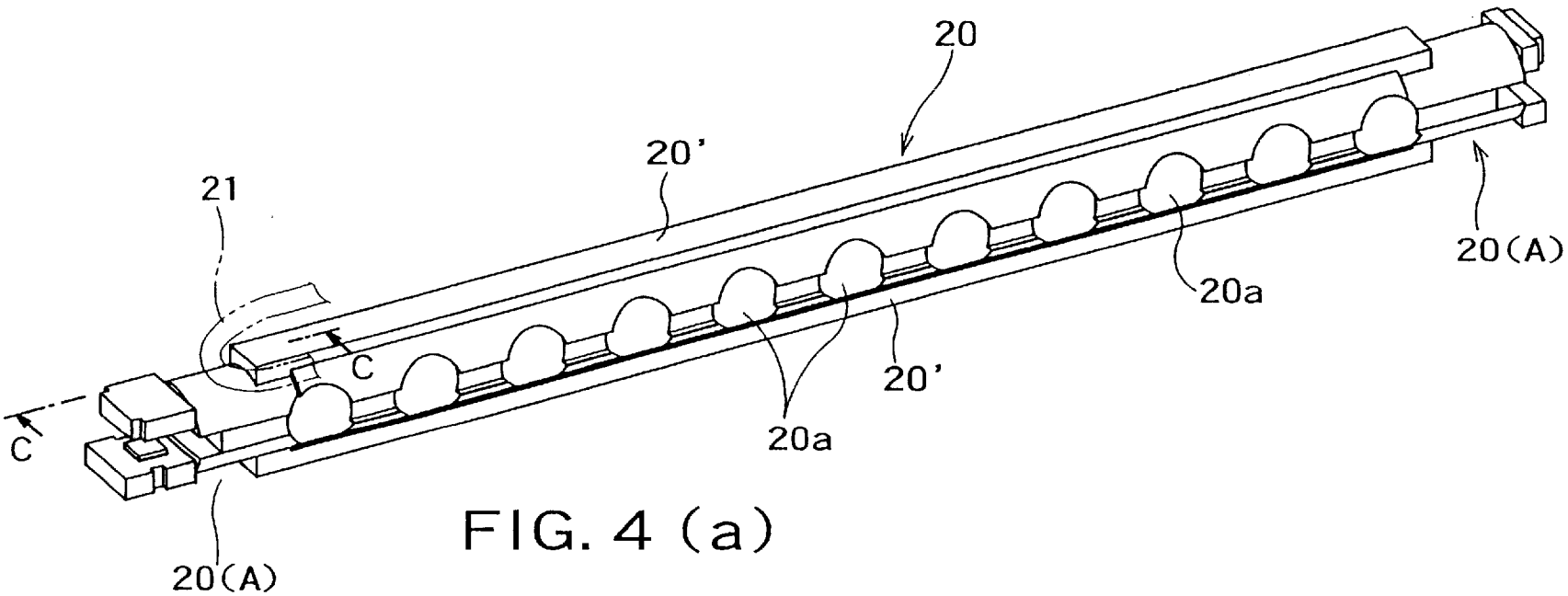
FIG. 4(*a*) is a perspective view of an end portion of a coil wound onto a core, FIG. 4(*b*) is a sectional view of the coil in an usual state, and FIG. 4(*c*) is a sectional view of the coil in a deformed state.
Figure 4:
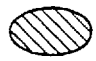
Figure 4:
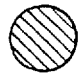

FIG. 4(*a*) shows an example of the core 20 of the induction heating device 6. The coil 21 is wound onto the core 20 in the axial directions thereof. Thus, in the vicinity of both ends of the core 20, the coil 21 is bent in the shape of U at a tension applied by winding, so that it is not possible to prevent the shape of the cross section of the coil 21 from changing from a complete round shown in FIG. 4(*b*) to an ellipse or flat oval shown in FIG. 4(*c*). That is, if the coil expressed by 21 is cut along a cutting plane line C—C in FIG. 4(*a*), the cross section of the coil 21 is as shown in FIG. 4(*c*), not FIG. 4(*b*). Therefore, if the core 20 is not devised, the diameter of the core 20 plus coil 21 in the vicinity of the end portion of the core 20 is greater than the diameter in the central portion thereof. In order to avoid this, small diameter neck portions 20(A) are provided on both ends in this preferred embodiment as can be seen from FIG. 4(*a*). That is, the diameters of the end winding portions 20(A), 20(A) are smaller. Thus, after the winding of the coil 21 onto the core 20 is completed, the difference between the outside diameter of the induction heating device 6 and the inside diameter of the heating roller 2, i.e., the gap therebetween, can be uniform in the central portion of the core 20 in longitudinal directions and in both end portions thereof. That is, it is possible to prevent the outside surface of the coil 21 from approaching the inside surface of the heating roller 2 on both ends in axial directions, so that it is possible to prevent the gap from decreasing.

Figure 5:
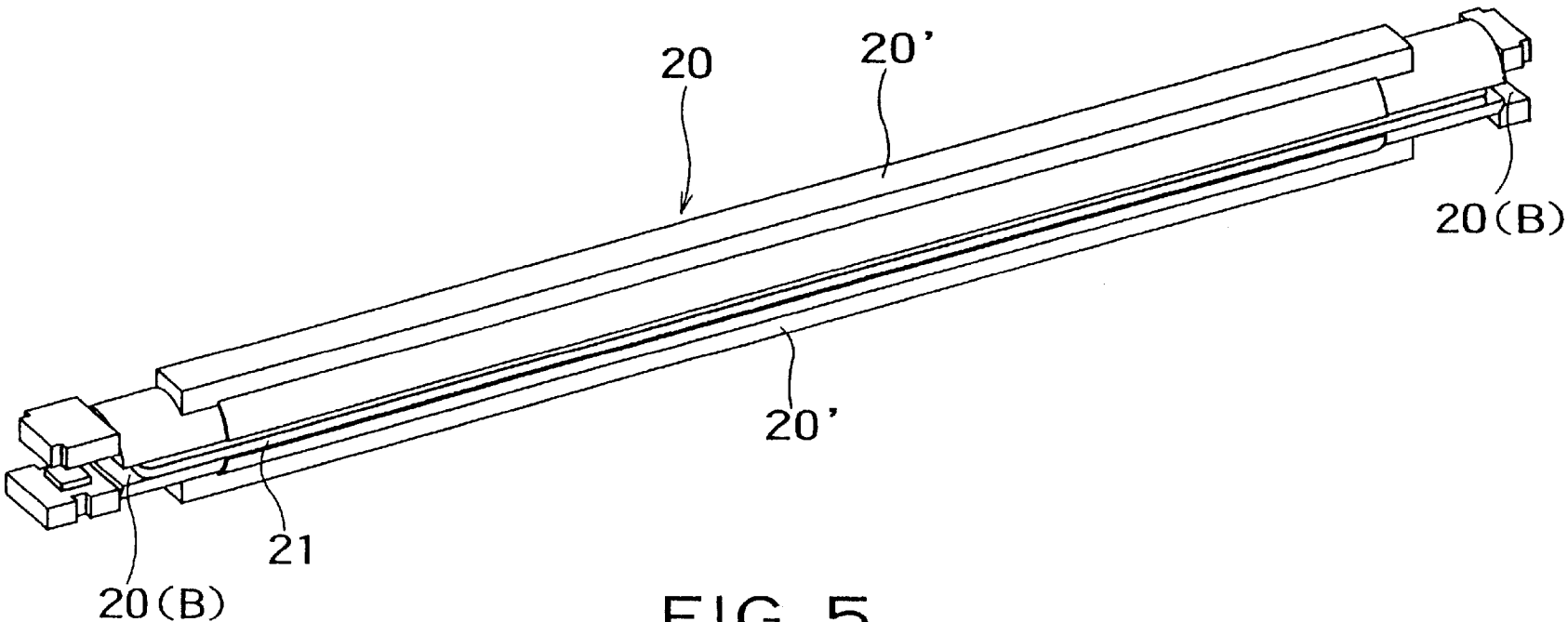
FIG. 5 is a perspective view of a core.

FIG. 5 shows a way of winding the coil 21 onto the core 20. In this winding way, first two turns are wound between grooves 20(B) and 20(B), which are formed in both end portions so as to face each other in axial directions, in view of the facility in winding. However, in such winding, the distance between the coil 21 and the heating roller 2 in the vicinity of both ends is greater than that in the central portion. Therefore, as the induction heating device 6, the heating distribution in both end portions is different from that in the central portion, so that the temperature for heating the heating roller 2 is uneven in axial directions. That is, the heat generation in both end portions is smaller than that in the central portion. Because the coil 21 enters the grooves 20(B), 20(B) in both ends of the core 20 to be greatly spaced from the heating roller 2 in both ends of the core 20 as can be seen from the foregoing. On the other hand, in FIG. 6, first two turns are wound onto the outside portions (neck portions 20(A)) of the core 20 similar to turns in the central portion without being wound between grooves 20(B) and 20(B) in both ends of the core 20 as shown in FIG. 5. That is, as can be seen from FIG. 6, the turns are wound onto the outer peripheries of the narrow neck portions 20(A), 20(A) formed in both ends of the core 20. In this case, two turns of the coil 21 are embedded in grooves formed in the neck portions 20(A), 20(A) so as not to protrude from the outer peripheries of the neck portions 20(A), 20(A). Thus, the coil 21 has the same plane as the neck portions in the vicinity of the both end portions, and contributes to heat generation in this state. Thus, the heat generation in the both end portions is equal to the heat generation in the central portion. Thereafter, the turns of the coil 21 are wound onto the core 20.

Figure 6:
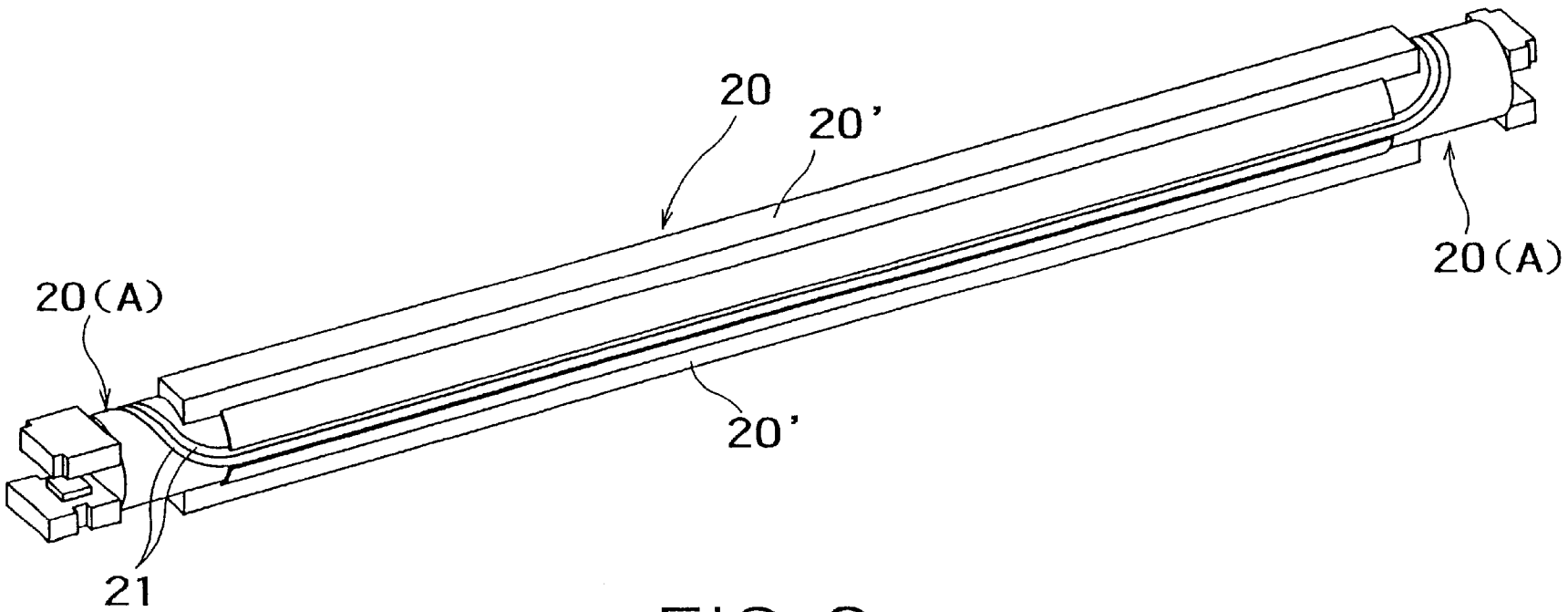
FIG. 6 is a perspective view of a core.

Furthermore, while the first two turns are wound onto the upper surface sides of both of the neck portions in FIG. 6, one turn may be wound onto the upper side and the other turn may be wound onto the lower side.

Figure 7:
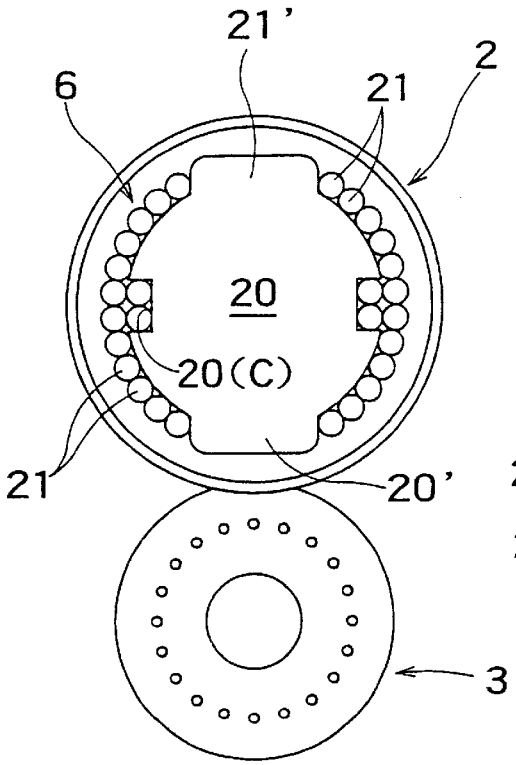
FIGS. 7(*a*) and 7(*b*) are cross-sectional views of examples of coils wound onto a core.
Figure 7:
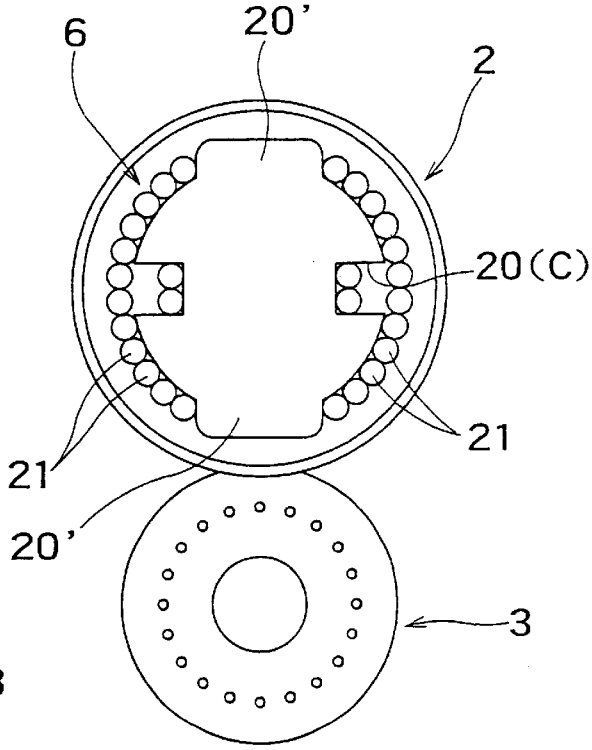

FIGS. 7(*a*) and 7(*b*) show another example of a core 20. FIG. 7(*a*) shows a cross section in the vicinity of both ends of the core 20, and FIG. 7(*b*) shows a cross section in the central portion of the core 20. In this example, grooves 20(*c*) for housing there in the first two turns of the coil 21 wound onto the core 20 are deeper in the central portion in axial directions, and shallower in the vicinity of both ends. Thus, the heating roller 20 is uniformly heated by the coil 21 in both of the central portion and both end portions of the core 20.

Figure 8:
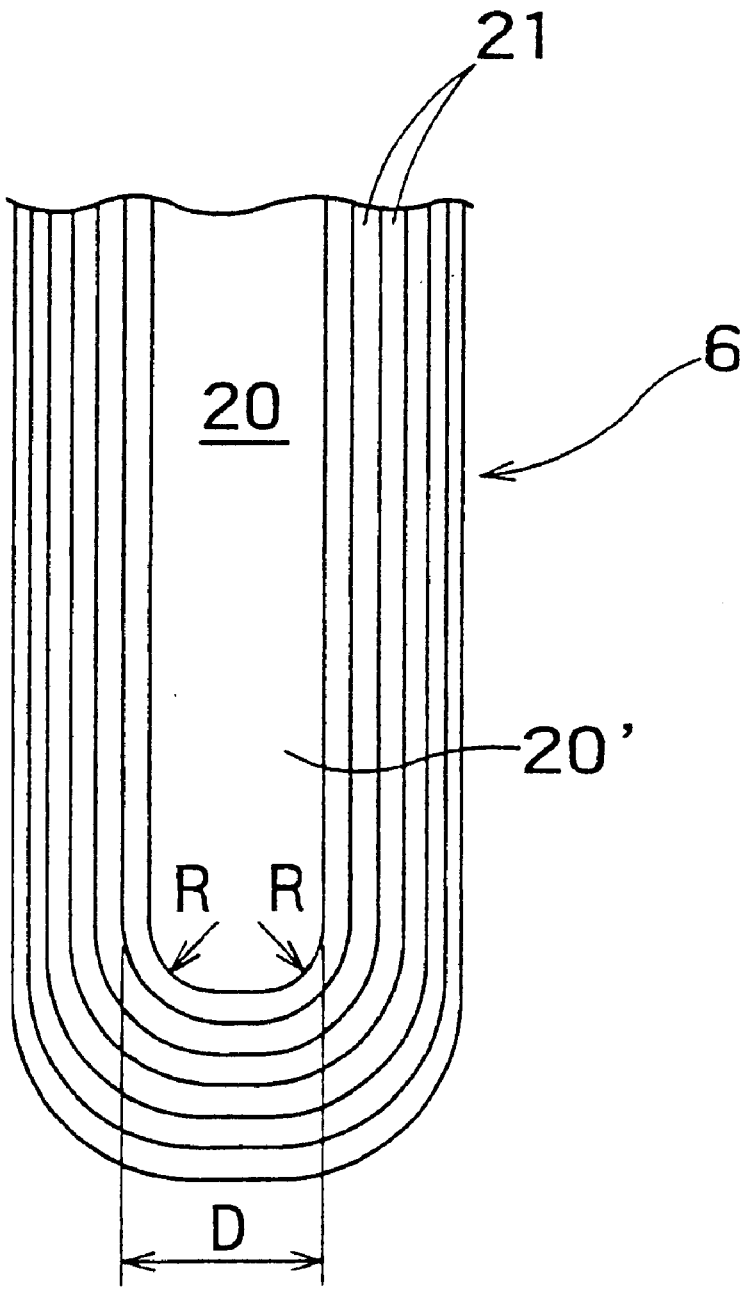
FIG. 8 is an illustration for explaining an end portion of a core and coils.

FIG. 8 shows the state of the coil 21 wound onto the core 20. For example, FIG. 8 shows an end portion wherein the coil 21 shown by a two-dot chain line in FIG. 4 is wound onto the core 20. In this end portion, the coil 21 is bent in the form of a so-called U-turn. As shown in FIG. 8, the coil 21 is wound onto the end of the core 20 so as to have two radii R, R of curvature. Thus, the traveling length of the coil 21 increases in both end portions of the core 20, so that it is possible to ensure sufficient heat generation even in both end portions, in which the heating value tends to decrease. Specifically, as can be seen from FIG. 9, assuming that the radius of curvature of the coil 21 is R and the distance between turns of the innermost periphery is D, $R<D/2$ is set. Such a winding way may be carried out in at least one end portions of the core. In addition, one or more turns may be wound by such a winding way. Moreover, while the coil 21 has two radii of curvature when it is wound in the shape of U, the coil 21 may be wound so as to have at least one radius R of curvature.

Figure 9:
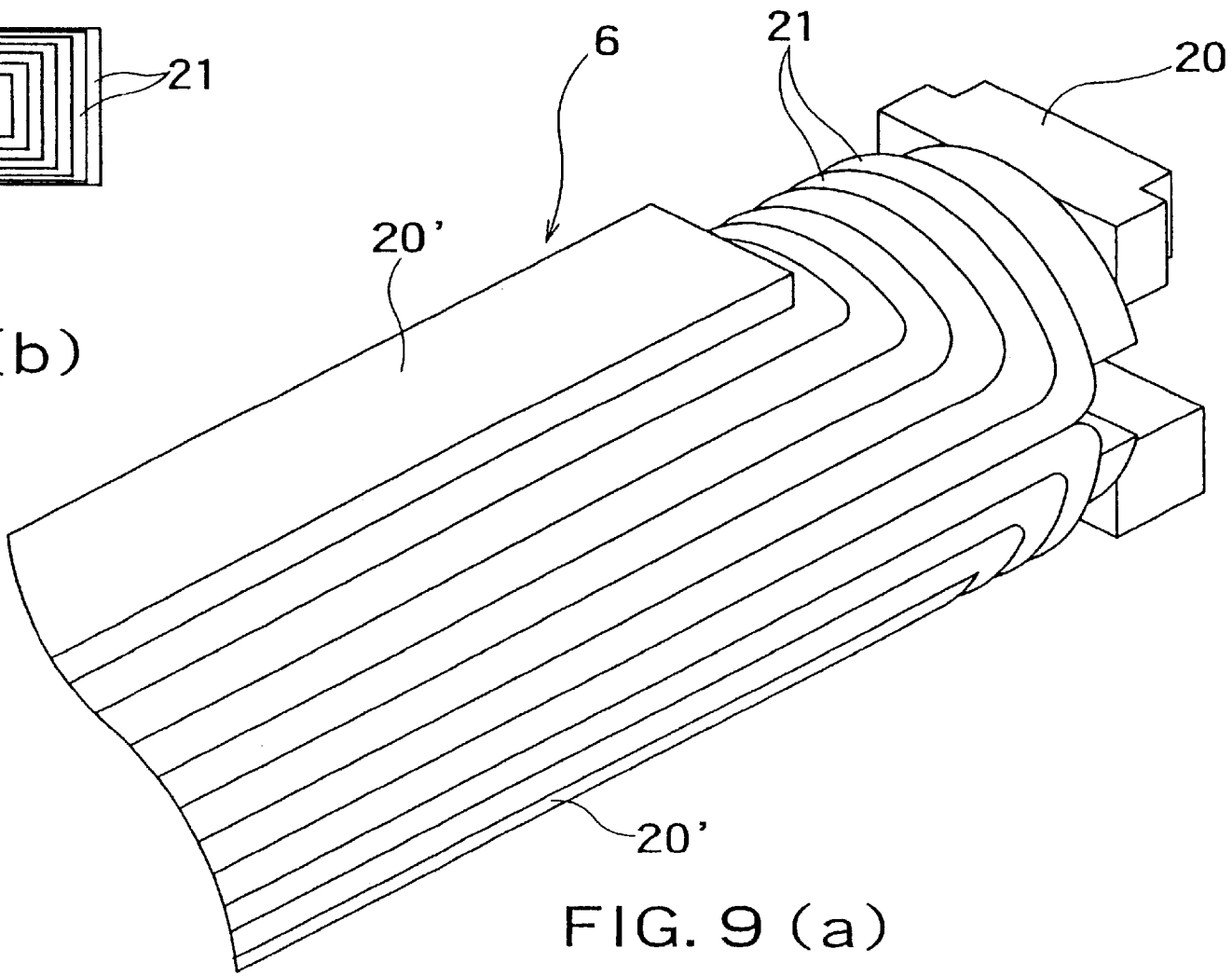
FIGS. 9(*a*) and 9(*b*) are partially perspective views of coils wound onto a core.
Figure 9:
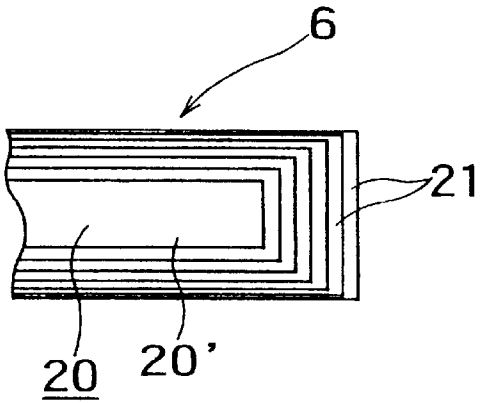

FIGS. 9(*a*) and 9(*b*) show another example of a way of winding the coil 21 onto the core 20, and are partially perspective and plan views. In this example, in order to sufficiently heat both end portions of the core 20 by the coil 21, the winding direction of the coil 21 is perpendicular to the axis to increase the length of the coil 21 in this portion to sufficiently heat the end portions. That is, as can be seen from FIGS. 9(*a*) and 9(*b*), the coil 21 travels on the core 20 along the axis thereof, bent at the end portion in a direction perpendicular to the axis, bent perpendicularly again to travel along the axis, and travels along the axis of the core 20 again in the reverse direction. When the coil 21 is wound as a single layer, at least two turns may have the wound portions perpendicular to the axis as described above. When the coil 21 is wound as a multiplex winding, two turns or more of at least the outermost layer of the coil 21 may be wound by the above described winding way. In this case, it is required to prevent the variation in gap between the coil 21 and the heating roller 2 serving as an object to be heated. Such a winding way may be carried out in at least one end portion of the core 20. In addition, when the above described winding way is carried out in one end portion of the core 20, at least one of the two curvature portions may be bent by about 90° to increase the length of the coil 21 traveling in this end portion.

Figure 10:
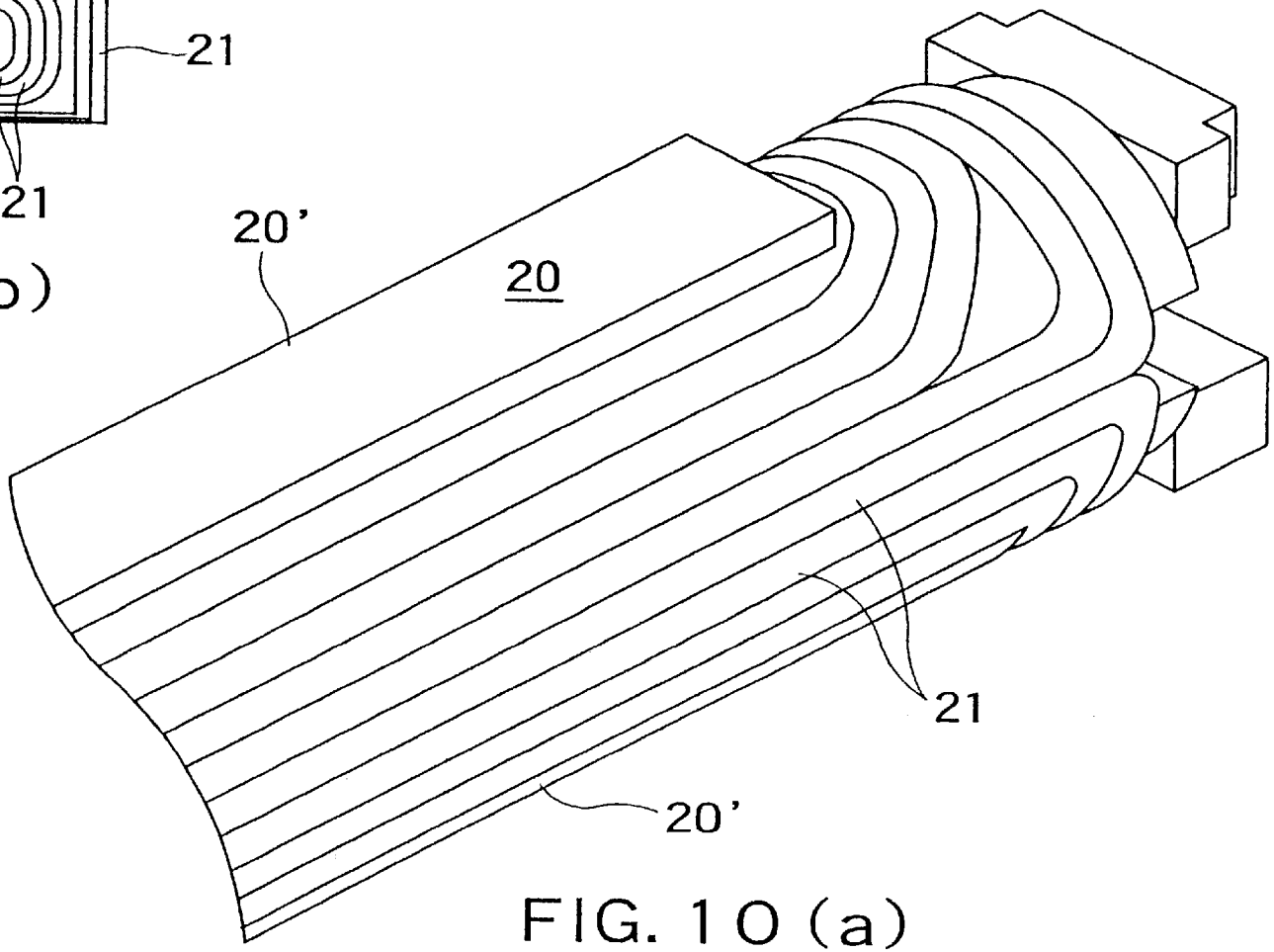
FIGS. 10(*a*) and 10(*b*) are partially perspective and plan views of coils wound onto a core.
Figure 10:
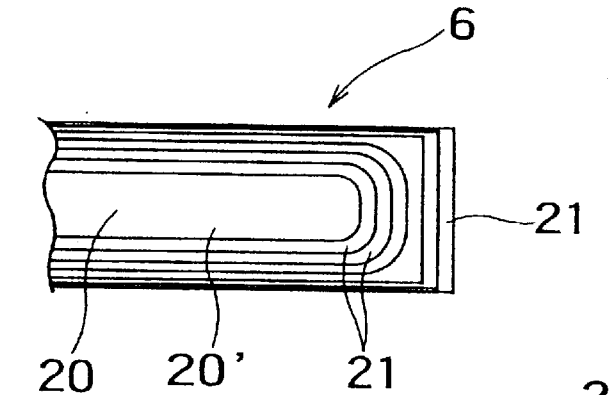

The example shown in FIGS. 10(*a*) and 10(*b*) is substantially the same as the example shown in FIGS. 9(*a*) and 9(*b*), except that the inside three of the turns of the coil 21 are roundly wound, and only the outside two turns are angularly wound as shown in FIGS. 9(*a*) and 9(*b*).

Figure 11:
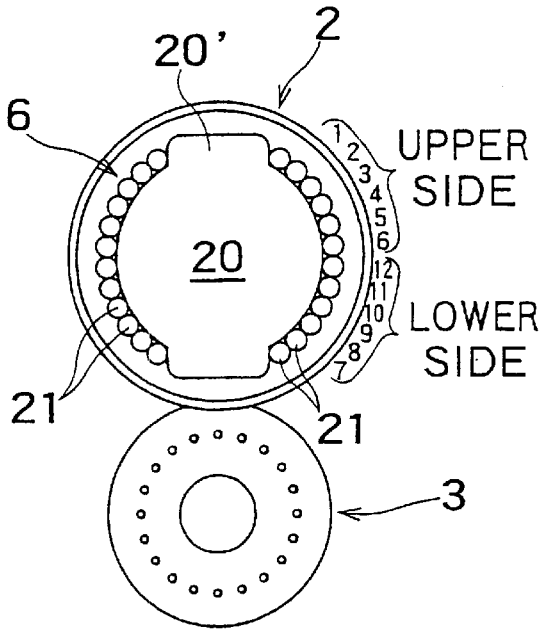
FIG. 11 is a cross-sectional view of a core, coils, a heating roller and a pressure roller.
Figure 12:
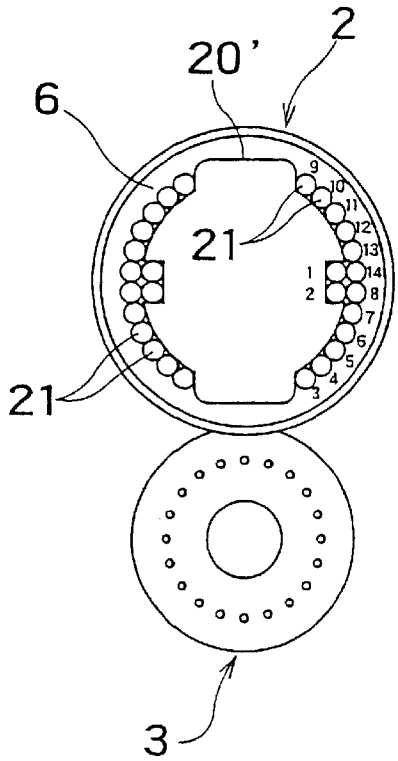
FIG. 12 is a cross-sectional view of a core, coils, a heating roller and a pressure roller.

FIG. 11 shows an example characterized by a way of winding the coil 21 onto the core 20.

That is, FIG. 11 shows a single layer winding of the coil 21. In this case, the turns of the coil 21 are wound in order of number in this figure. That is, the first through sixth turns of the coil 21 are first wound onto the core 20 downwards from the top, the coil 21 travels to the lowermost side, and then, the seventh through twelfth turns are wound upwards from the bottom. According to such a winding way, the coil 21 can be wound onto the core 20 by a series of operations. Thus, it is not required to separately form and combine the first through sixth turns of the coil and the seventh through twelfth turns of the coil. Also when the coil 21 is wound so as to form three layers or more, the coil 21 can be wounded by a series of operations according to the same winding way.

Figure 13:
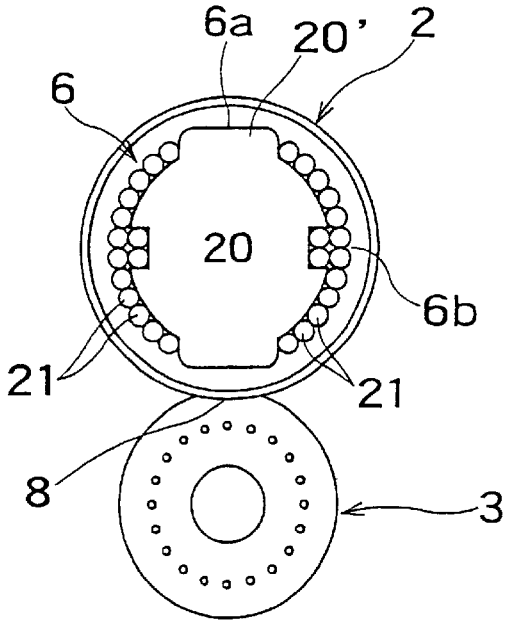
FIG. 13 is a cross-sectional view of a core, coils, a heating roller and a pressure roller.

FIG. 13 shows an example of a duplex winding. Also in this case, the coil 21 can be wound by a series of operations by winding the coil 21 in order of number as shown in the figure.

FIG. 13 shows an example of a layout of the induction heating device 6. The heating roller 2 is arranged outside of the induction heating device 6, and the pressure roller 3 is arranged below the heating roller 2 so as to pressingly contact the heating roller 2. The induction heating device 6 has a weak heating portion 6*a* wherein the coil 21 does not exist, and a strong heating portion 6*b* wherein the coil 21 is densely wound. If the time for the strong heating portion 6*b* to face the pressure roller 3 is long, the deterioration of the pressure roller 3 is promoted. That is, the weak heating portion 6*a* is caused to face the pressure roller 3. That is, the weak heating portion 6*a* of the induction heating device 6 is arranged so as to face the nip portion 8.

Figure 14:
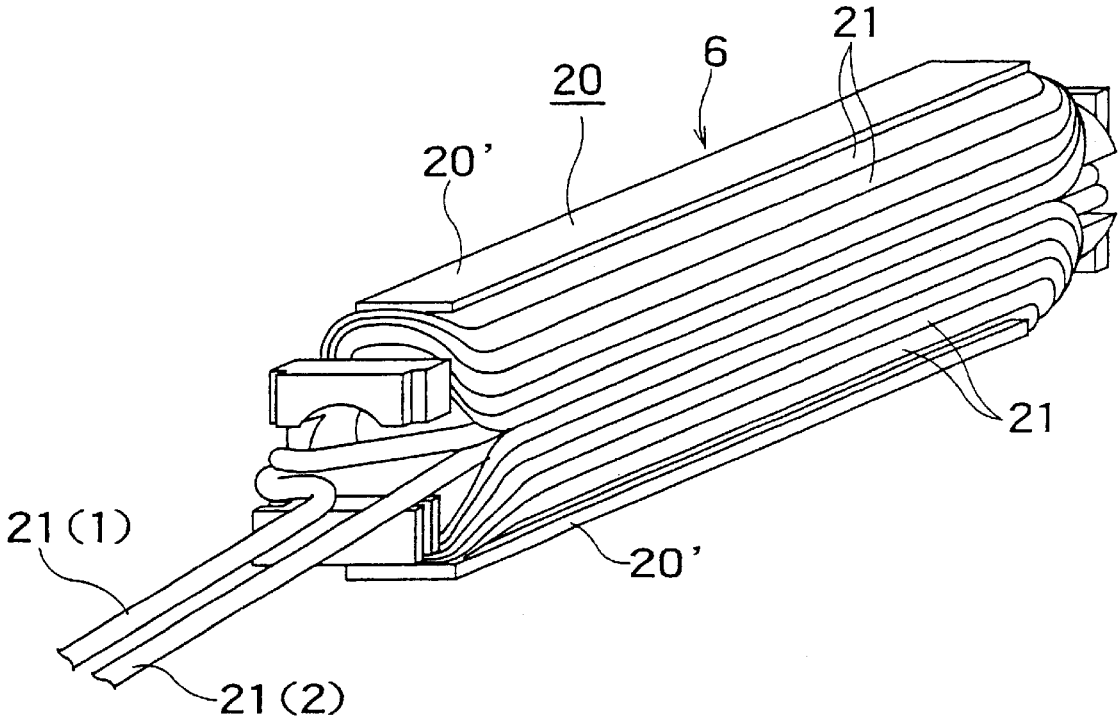
FIGS. 14(*a*) and 14(*b*) are perspective and partially perspective views of a core and coils.
Figure 14:
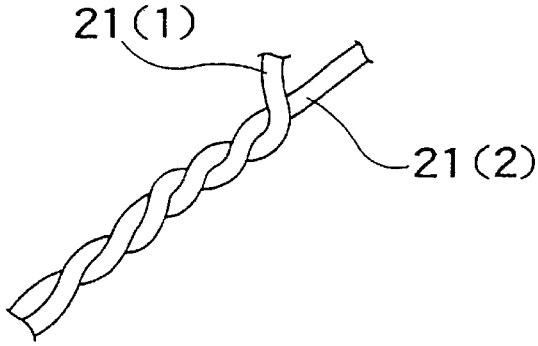

FIGS. 14(*a*) and 14(*b*) show examples of the insulation for the coil 21. That is, the coil 21 wound onto the core 20 has two end portions of a leading end portion 21(1) and a trailing end portion 21(2). FIG. 14(*a*) shows an example where the two end portions 21(1) and 21(*b*) are attached to each other in parallel, and FIG. 14(*b*) shows an example where the end portions are twisted. In general, since a high frequency current is supplied to the coil 21, it is not possible to avoid the generation of noises. However, since currents pass through the leading end portion 21(1) and trailing end portion 21(2) of the coil 21 in reverse directions to each other, electromagnetic influences are canceled out to inhibit the generation of noises by attaching the two end portions to each other. The examples shown in FIGS. 14(*a*) and 14(*b*) provide this effect. By attaching the two end portions to each other as shown in these figures, the generation of noises is inhibited.

According to the above described preferred embodiments of the present invention, the following effects can be obtained as described above.

(1) Since the coil 21 is long, there are some cases where the coil 21 can not be wound by one layer. In this case, the coil 21 is wound by a plurality of layers, and it is considered that the coil 21 is wound by three layers to prevent all of the coil 21 from being wound by two layers. The third layer is embedded in a deep groove formed in the core. In this case, by preventing the going and returning portions of one turn of the coil from being too close to each other, it is possible to inhibit the magnetic fields from being canceled.

(2) The coil 21 is wound onto the core 20 along the axis thereof. At this time, the coil is intended to be crushed to increase its height in the vicinity of both ends so as to increase in radial directions of the core 20. However, since the neck portions are formed in both end portions of the core 20, it is possible to prevent the diameter of the wound coil from increasing to form a uniform gap between the coil 21 and the inside surface of the heating roller 2.

(3) In the winding of the coil 21 onto the core 20, the gap between the coil 21 and the heating roller 2 tends to increase in both end portions of the core 20. Therefore, when the coil 21 is wound onto the heating roller 2, the distance between the coil 21 and the inside surface of the core 20 is set so as not to increase in both end portions, so that it is also possible to appropriately heat the both end portions of the heating roller 2.

(4) When the coil 21 is wound onto the core 20 partially as a duplex winding, that portion greatly contributes to the generation of heat. In order to avoid this, the lower layer coil of the two layers of the coil portions is embedded in the groove formed in the core 20. Therefore, it is possible to prevent only the duplex winding portion from more greatly generating heat than the other single winding portion. Thus, it is possible to prevent the nonuniformity of heat generation distribution of the heating roller 2 to optimize the temperature distribution.

(5) When the coil 21 is wound onto the core 20, the coil 21 is bent in both end portions so as to have a bend radius as a U-turn along the axial directions (longitudinal directions). Therefore, it is possible to increase the area (length) wherein the coil 21 faces the heating roller at the bent portion, so that it is possible to optimize the heat generation distribution of the heating roller 2.

(6) When the coil 21 is wound onto the core 20, each of the both end portions have a portion, at which the coil 21 is wound onto the core 20 so as to be bent around the axis of the core 20. Therefore, it is possible to heat the heating roller 2 so that the temperature distribution is appropriate in longitudinal directions.

(7) When the coil 21 is wound onto the core 20, the winding way is devised, so that the coil 21 can be wound by a series of operations. Therefore, even if the coil 21 is wound so as to have a complicated shape, the winding can be carried out by a series of operations, so that it is possible to improve the working efficiency.

(8) When the induction heating device 6 having the coil 21 wound onto the core 20 is fixed to the body 4, the central portion, in which the coil 21 is closely wound, does not face the pressure roller 3 (nip portion 8), so that it is possible to prevent the pressure roller 3 from being excessively heated by turning the power supply ON. Thus, it is possible to inhibit the surface state, such as gloss, of a fixed paper from being greatly changed by turning the power supply ON for the coil 21.

(9) The input and output portions of the outgoing line of the coil 21 are attached to each other, so that the electromagnetic field effects can be canceled.

As described above, according to the present invention, the heating roller can be appropriately heated by the induction heating coil so that its temperature distribution is uniform from both ends to the central portion, and the winding of the coil onto the core can be easily carried out by a series of operations. Moreover, it is possible to inhibit noises from being generated in the outgoing line portion.

While the present invention has been disclosed in terms of the preferred embodiment in order to facilitate better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

What is claimed is:

1. A fixing device using induction heating, comprising:

an endless member having a metal layer of a conductive material; and an electromagnetic induction coil arranged close to said endless member, alternating current being supplied to said coil, thereby generating heat to heat up said endless member, said coil being wound onto a core member arranged in a width direction of said endless member, and an expansion of a folded portion of said coil being absorbed by a narrower portion of said core member, thereby maintaining to be constant the width of a gap between said coil and said endless member.

2. A fixing device using induction heating as set forth in claim 1, wherein said coil is wound onto said core member, which is long, in the longitudinal direction thereof, said core member includes end portions having a narrower neck portion, and said folded portions of said coil correspond to said neck portions of said core member, so that even if a cross section of said coil is deformed by a tensile force generated by the winding of said coil, the outer surface of said coil wound onto said core member is inhibited from approaching said endless member, since the deformations are absorbed by said neck portions.

3. A fixing device using induction heating as set forth in claim 2, wherein said endless member is a roller.

4. A fixing device using induction heating as set forth in claim 1, wherein said endless member is a roller.

5. A fixing device using induction heating as set forth in claim 1, wherein:

said coil is wound onto said core member, which is long, in the longitudinal direction thereof, said core member includes a central portion and end portions provided at both sides thereof, each of said end portions being narrower than said central portion, said central portion has two projecting portions, being provided at side surface of said central portion so as to be opposite to each other relative to the central axis of said core member, extending in an axial direction of said core member, and serving as cores for winding said coil, and even if a cross section of said coil is deformed by a tensile force generated by the winding of said coil, said coil wound onto said core member is inhibited from approaching said endless member, since the deformation is absorbed by said narrower end portions.

6. A fixing device using induction heating as set forth in claim 5, wherein said endless member is a roller.

* * * * *